United States Patent [19]

White et al.

[11] Patent Number: 4,850,500

[45] Date of Patent: Jul. 25, 1989

[54] DIMPLED ARC TUBE HAVING NO INTERNAL END POCKETS AND A LAMP EMPLOYING SAME

[75] Inventors: Philip J. White, Georgetown; James C. Morris, Wakefield; William M. Keeffe, Rockport, all of Mass.

[73] Assignee: GTE Products Corporation, Danvers, Mass.

[21] Appl. No.: 275,451

[22] Filed: Nov. 23, 1988

Related U.S. Application Data

[63] Continuation of Ser. No. 943,978, Dec. 18, 1986.

[51] Int. Cl.[4] ..... H01J 61/30

[52] U.S. Cl. ..... 220/2.1 R; 206/0.5; 313/634

[58] Field of Search ..... 220/2.1 R, 2.3 R; 206/0.5, 0.6; 313/634, 631, 623; 315/116, 51, 73; 445/6

[56] References Cited

U.S. PATENT DOCUMENTS

| | | | |
|---|---|---|---|
| 3,384,781 | 5/1968 | Holle | 220/2.1 R |
| 4,161,672 | 7/1979 | Cap et al. | 313/634 |
| 4,396,857 | 8/1983 | Danko | 313/634 |
| 4,498,027 | 5/1985 | Karlotski et al. | 313/634 |
| 4,724,361 | 2/1988 | Wada et al. | 313/634 |

*Primary Examiner*—Willis Little

*Attorney, Agent, or Firm*—Joseph S. Romanow

[57] ABSTRACT

The present invention is directed to a method for the elimination of end pockets in metal halide arc tube envelopes (or other irregularities) in order to improve the color stability thereof.

The present invention is also directed to the improved lamps having reduced or substantially eliminated end pockets.

The magnitude of this improvement will increase with decreasing arc tube size, since in smaller arc tubes, the tube ends represent a larger fraction of the overall inner surface of the device.

10 Claims, 3 Drawing Sheets

DIMPLED ARC TUBE HAVING NO INTERNAL END POCKETS AND A LAMP EMPLOYING SAME

This is a continuation of co-pending application Ser. No. 943,978 filed on Dec. 18, 1986.

BACKGROUND OF THE INVENTION

The invention relates to electric discharge lamps of the high pressure metal vapor type and is especially applicable to such lamps having a metallic halide fill.

High pressure metal vapor arc discharge lamps generally comprise an elongated arc tube made of quartz or fused silica, the ends of which are sealed either by blow molding or by having pinched or pressed seals. The arc tube contains a quantity of mercury along with an inert starting gas such as argon and is provided with electrodes at opposite ends extending through the blow moldings or supported by the pinch or press seals.

Metallic halide lamps contain, in addition to the mercury and starting gas, one or more metal halides such as sodium, thallium, and indium iodides, or sodium and scandium iodides. In commercial metal halide lamps, the arc tube is generally enclosed within a vitreous outer envelope or jacket provided with a screw base at one end.

Arc tubes have been made utilizing a so-called full press seal, wherein the entire end segment of a piece of quartz or fused silica tubing is collapsed and sealed off. This is done by pinching the ends of the quartz tube while in a heat-softened condition between a pair of opposed jaws to press the quartz about a foliated inlead supporting an electrode on its inner end. The jaws contact and compress only the end portions of the quartz tube, thereby forming the press or pinch seal.

The immediately adjacent quartz which is viscous at the instant of pinching assumes a generally rounded shape in the transition zone between the cylindrical main body of the arc tube and the press seal which may be referred to as the end chamber.

Another method which is widely used in the lighting industry for shaping the end wells in quartz arc tubes, is commonly known as "blow molding".

In the blow molding process, a hemispherically shaped cavity is formed by the press feet when the seal is made and a slight excess pressure of inert gas is applied to the inside of the arc chamber. This gas pressure forces the plastic quartz to expand into the mold thus shaping the end of the arc tube.

The shape of the end chambers, that is of the space around and behind the electrodes, will vary with the type of quartz, the wall thickness, the heat concentration and the nitrogen pressure build-up during pressing.

That the inside surface of the arc tube should be smooth and free of angular crevices, corners, or pockets has previously been reported, see for example, U.S. Pat. No. 2,965,698. However, the realization of this need has not yet resulted in any one method suitable for totally achieving the stated requirement, see, for instance, U.S. Pat. No. 3,939,538 which recites advantages of the blow molding method over the press seal method.

While the blow molding method does provide some degree of control over the shape of the end well, it does not eliminate or prevent the formation of end pockets where the press seal meets the arc tube.

In any metal halide lamp the color temperature is controlled by the coldest spot temperature in the arc tube, which in turn determines the vapor pressures of the radiating species.

To have a lamp with reduced color temperature variations, what is really needed is an arc tube geometry in which the cold spot temperature does not vary, or at least is less sensitive to changes in the lamp's operating or burning position.

Modifications of arc tube inner geometry are thus constantly being explored, due in part, to the difficulty of control experienced during press sealing and blow molding.

The present invention represents yet another method for the modification of the internal geometry of arc tubes, in this case for the purpose of reducing color temperature variations in metal halide arc tubes.

A surprising benefit derived from this invention was the discovery that a GTE Sylvania M100 arc tube, modified in accordance with the present teachings, would operate with equal efficiency in both the vertical and horizontal positions. Unmodified M100 arc tubes suffered from both reduced lumen output and increased color temperature when changed from the normal vertical operating position to the horizontal.

SUMMARY OF THE INVENTION

After discovering unwanted end pockets in the GTE M100 lamps, the present inventors sought methods for removing them with the goals of (1) not adversely affecting the output of the lamp; and (2) affording any improvements in the quality of light output.

The present invention is thus directed to a method for the elimination of end pockets in metal halide arc tube envelopes (or other irregularities) in order to improve the color stability thereof.

In one preferred embodiment of the present invention, the unwanted end pockets are eliminated during the manufacturing process of the arc tubes. Thus, this method comprises the sequential steps of;

(a) forming a vertical or horizontal first press seal at each end of the arc tube; and (b) at a pressing angle perpendicular to that of the first press seal, flattening and dimpling said first pressed seal at the press - arc chamber junction. In this manner the area where end pockets are otherwise formed, may be substantially or completely eliminated.

In another preferred embodiment of the present invention, commercially available (or otherwise preformed) arc tubes may be improved by the present invention. Thus, this invention is also directed to a method of improving arc tubes, which comprises the steps of:

(a) analyzing the arc tube for the presence of one or more end pockets; and (b) substantially eliminating said end pocket or pockets by at least partially collapsing the arc tube wall into said pocket or pockets, without adversely affecting the output efficiency of the lamp.

In most preferred embodiments, the method of analyzing the arc tubes should be a non-destructive method, although destructive methods, such as breaking the tube may also be employed if desired.

The present invention is also directed to the improved lamps having reduced or substantially eliminated end pockets.

It has also been discovered that the magnitude of this improvement will increase with decreasing arc tube size, since in smaller arc tubes the ends represent a larger fraction of the inner surface of the device.

DETAILED DESCRIPTION OF THE PREFERRED EMBODIMENTS

The present invention is directed to a method of forming or treating an arc tube, preferably for a metal halide lamp, such that end pockets or other internal tube irregularities, e.g., angular corners on the interior of the arc tube, are eliminated.

Since the col spot temperature is generally located in the end wells of the lamp, the present inventors turned their attention to the shape of these end wells to see if there was any simple way to improve their geometry to achieve the desired results.

As the experimental vehicle there was chosen the M100 watt arc tube recently developed by GTE Sylvania.

Figure 1:
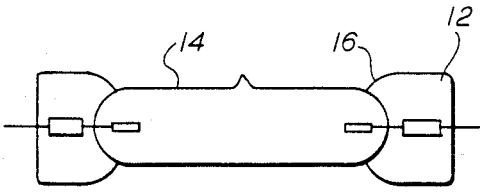
FIG. 1 PRIOR ART
FIG. 1 is a longitudinal view of a standard M100 watt arc tube.
Figure 2:
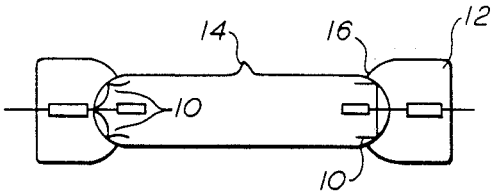
FIG. 2 represents a sectional view of the standard M100 watt arc tube of FIG. 1, revealing the contours of the inner chamber.

When these lamps were examined in neatsfoot oil, it was discovered, with much surprise, that there was present in every lamp, deep end pockets 10 in the area where the press seal 12 meets the body 14 of the arc tube (herein referred to as the arc chamber - press seal junction 16). (See FIGS. 1 and 2).

Thus, while the external portions of the lamps described in the figures may be in the "prior art," the discovery of unwanted end pockets and/or corners on the inner surface of said lamps is not.

These pockets were not intentionally designed into the arc tube, and are, in essence, an artifact of the press seal manufacturing process.

This closure geometry is what is generally obtained in the lighting industry when press seals are made, and the only type of crevice that most engineers worry about, or even look for, are crevices directly adjacent to the electrode.

Prior to our invention, the arc tube ends were press or pinch sealed using conventional techniques such as that described in U.S. Pat. No. 2,965,698 to Gottschalk, and commercial production was generally conducted by a quartz lamp sealing machine such as that disclosed in U.S. Pat. No. 2,857,712 to Yoder et al.

In such processing, a quartz tube is supported in a head of a pinch sealing machine and has its exhaust tubing accommodated in a gas supply port providing nitrogen to prevent oxidation of the inleads during the sealing operation.

The sealing or pinching is performed at a station where oxy-hydrogen burners heat the lower end of the quartz tube to a plastic state. At the proper moment, the burners are withdrawn and a pair of pinching jaws are rapidly moved firstly up into alignment with the lower end of the quartz tube and then in horizontally against the sides of the tube. If this is the first end of the quartz tube to be sealed, the other end is stoppered.

At the moment of pinching, the end chamber is formed by the back pressure of nitrogen which forces the soft quartz outward. The shape of the end chamber is determined by the viscosity of the quartz which is temperature dependent, the nitrogen back pressure, and the jaw closing speed.

During operation of a typical lamp of the prior art, the corners run significantly cooler than the remainder of the body of the arc tube and the color temperature is adversely affected thereby.

By eliminating the angular corners, the arc tube operates closer to isothermal and color temperature is improved.

In at least one preferred embodiment of the present invention, the arc tube differs structurally from the prior art in that there are notches or "dimples" at the juncture of the press seals and arc tube body (and the interior is smooth, i.e., without angular corners).

As stated above, the present invention utilized the existing Sylvania M100 arc tube as the test vehicle for developing an arc tube with improved color temperature stability.

The standard Sylvania M100 design arc tube was chosen since it was originally designed for high efficiency (90 LPW) and low color temperature (3000° K.) when operated in the vertical position only. When operated in the horizontal position it give typical results summarized in Table 1.

TABLE 1

Standard 100 watt lamps
Horizontal operation - tip-off up

| Volts | Watts | Lumens | Color Temp. |
|---|---|---|---|
| 97.6 | 100 | 9255 | 3363 |
| 95.8 | 100 | 8700 | 3278 |
| 101.7 | 100 | 8122 | 3670 |
| 102.7 | 100 | 8052 | 3486 |
| 96.6 | 100 | 8214 | 3353 |
| 92.8 | 100 | 7923 | 3234 |
| 100.1 | 100 | 8985 | 3501 |
| 102.9 | 100 | 7957 | 3404 |
| 100.7 | 100 | 8871 | 3404 |
| 98.1 | 100 | 7352 | 3174 |

TABLE 1-continued

| | Standard 100 watt lamps Horizontal operation - tip-off up | | | |
|---|---|---|---|---|
| | Volts | Watts | Lumens | Color Temp. |
| | 101.6 | 100 | 8423 | 3841 |
| Average | 99.1 | 100 | 8352 | 3428 |
| Std. Dev. | 3.2 | 0 | 561 | 193 |

By conventional metal halide standards this type of variation in performance (efficacy down 7 LPW, color temp. up 400° K.) when going from vertical to horizontal would be considered to be quite good.

However, in keeping with the needs of modern society and the quest for the perfect metal halide lamp, this degree of output change is unacceptable, and certainly can be improved upon. Toward this end, the present invention, which can be described by the following two preferred methods for removing end pockets, were developed.

METHOD #1

Start with an already pressed arc tube which contains end pockets. Heat a small area around each pocket with a torch and depress the plastic quartz with a carbon rod, thus collapsing and sealing the end pocket. This method gives a rather crude looking arc tube, but the desired result is achieved - the end pockets are gone.

Figure 3:
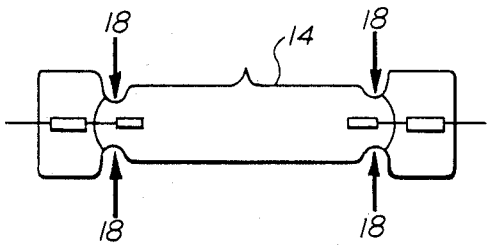
FIG. 3 is a longitudinal view of a M100 watt arc tube modified by crimping the ends thereof with a carbon rod.
Figure 4:
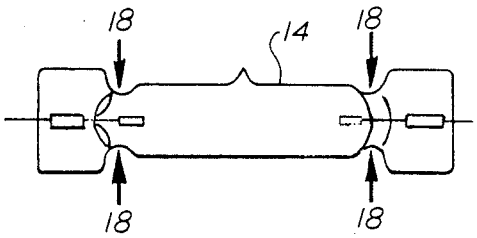
FIG. 4 illustrates the lamp of FIG. 3 sectioned to reveal the improved contours of the inner chamber.

An example of a conventional arc tube after being modified by this method is shown in FIGS. 3 and 4. FIG. 3 illustrates the exterior "dimples" 18 formed by the carbon rod in the arc tube body 14. FIG. 4 illustrates how the dimples 18 eliminate the angular end pockets 10.

METHOD #2

As a second, and more elegant, way of removing the end pockets, there was designed a press seal machine with 4 presses (2 pairs) to provide pressing capability in two mutually perpendicular planes.

With this machine a first press is made in the conventional manner with two opposing press feet 20 and 22 being driven into the hot quartz of the arc tube body 14. While these feet are still in contact with the hot quartz, a second pair of press feet 24 and 26 enter from the sides to flatten the sides of the press and to dimple in the quartz at the press—arc chamber junction area 16 where end pockets are normally formed.

Figure 5:
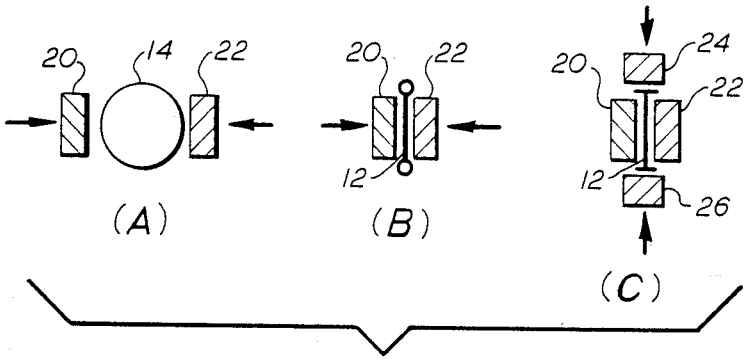
FIG. 5 illustrates the preferred pressing sequence of the present invention. The first frame (step a) represents the press feet approaching the quartz blank. The second frame (step b) shows the main press feet in contact with quartz as the seal is formed. The third frame (step c) shows the side press feet completing the press.

An end on view of this sequence is shown in FIG. 5.

Figure 6:
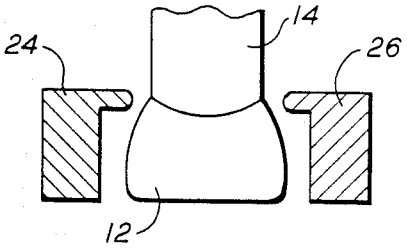
FIG. 6 illustrates the side press foot operation to remove end pockets. Frame A—The press seal has been formed by the main press foot (not shown) and the side press feet are approaching the hot quartz. Frame B—side press feet contact the quartz and crimp (dimple) the quartz at the press—arc tube joint region. Frame C—Press feet withdrawn.
Figure 6A:
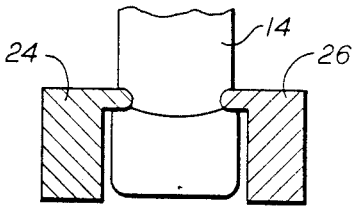
Figure 6B:
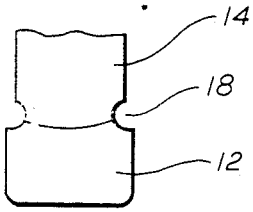

A side view of the secondary (side) pressing sequence is shown in FIG. 6 to indicate how the dimpling is accomplished.

For either way of forming the arc tube, the end result is the same. In each case the color uniformity of a group of lamps is improved, and the changes in lamp color temperature when the burning position is changed are reduced.

For lamps made by the first method (carbon red) typical data is shown in Tables 2, 3, and 4. Comparison of this data with that in Table 1 shows that by eliminating the end pockets, a substantial improvement in lamp operating efficiency has been achieved.

TABLE 2

| | Carbon rod crimped 100 watt lamps Vertical base up operation | | | |
|---|---|---|---|---|
| | Volts | Watts | Lumens | Color Temp. |
| | 94.8 | 100 | 8722 | 2886 |

TABLE 2-continued

| | Carbon rod crimped 100 watt lamps Vertical base up operation | | | |
|---|---|---|---|---|
| | Volts | Watts | Lumens | Color Temp. |
| | 97.0 | 100 | 9213 | 2841 |
| | 95.8 | 100 | 9498 | 3029 |
| | 88.6 | 100 | 9352 | 3060 |
| | 87.0 | 100 | 9855 | 3200 |
| | 91.6 | 100 | 9717 | 3069 |
| Average | 92.5 | 100 | 9393 | 3014 |
| Std. Dev. | 4.1 | 0 | 403 | 131 |

TABLE 3

| | Carbon rod crimped 100 watt lamps Vertical base down operation | | | |
|---|---|---|---|---|
| | Volts | Watts | Lumens | Color Temp. |
| | 94.8 | 100 | 8996 | 2973 |
| | 89.2 | 100 | 9144 | 2727 |
| | 94.3 | 100 | 7987 | 2877 |
| | 99.0 | 100 | 9797 | 2940 |
| | 89.7 | 100 | 9604 | 3063 |
| Average | 93.4 | 100 | 9106 | 2986 |
| Std. Dev. | 4.0 | 0 | 705 | 122 |

TABLE 4

| | Carbon rod crimped 100 watt lamps Horizontal operation | | | |
|---|---|---|---|---|
| | Volts | Watts | Lumens | Color Temp. |
| | 102.7 | 100 | 9181 | 2964 |
| | 95.4 | 100 | 9359 | 2967 |
| | 103.0 | 100 | 8971 | 2986 |
| | 97.8 | 100 | 8993 | 2989 |
| | 95.0 | 100 | 8675 | 2896 |
| Average | 98.8 | 100 | 9036 | 2960 |
| Std. Dev. | 3.9 | 100 | 256 | 38 |

Some data for lamps made by the second method (4 way press seal) are shown in Table 5. These data show that by eliminating the end pockets these lamps also maintain a low color temperature when operated in the horizontal position.

TABLE 5

| | Press sealed crimped 100 watt lamps Horizontal operation | | | |
|---|---|---|---|---|
| | Volts | Watts | Lumens | Color Temp. |
| | 106.0 | 100 | 8895 | 2947 |
| | 95.3 | 100 | 8672 | 2954 |
| | 95.0 | 100 | 8521 | 3020 |
| | 89.4 | 100 | 8461 | 3046 |
| | 107.8 | 100 | 8595 | 2937 |
| | 98.7 | 100 | 8500 | 2997 |
| Average | 8.7 | 100 | 8622 | 2984 |
| Std. Dev. | 7.0 | 0 | 152 | 44 |

Based upon this disclosure, it will be apparent that the techniques of the present invention may be extended to other possible sizes (wattages) of metal halide lamps, and that improvements similar to those shown here are would be obtained by removing the end pockets in any other wattage lamp.

Figure 7:
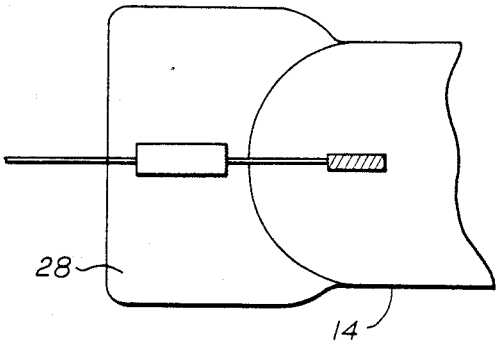
FIG. 7 PRIOR ART
FIG. 7 represents a longitudinal view of a conventional Sylvania 1000 watt arc tube with a blow molded end.
Figure 8:
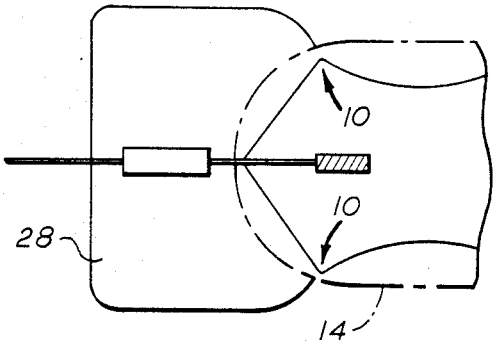
FIG. 8 illustrates a sectional view of a Sylvania 1000 watt arc tube with a blow molded end, revealing the contours of the inner chamber, and showing the presence of end pockets.

For example, as illustrated in FIG. 7 and 8, a Sylvania 1000 watt arc tube made with blow molded ends 28 shows the presence of end pockets 10.

Figure 9:
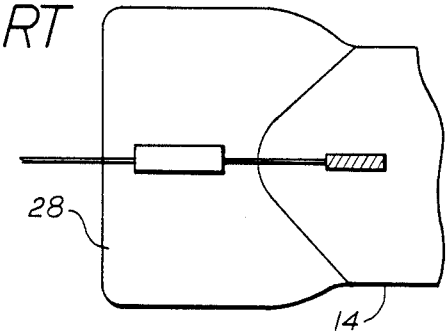
FIG. 9 PRIOR ART
FIG. 9 illustrates a longitudinal view of a conventional General Electric 400 watt arc tube with a blow molded end.
Figure 10:
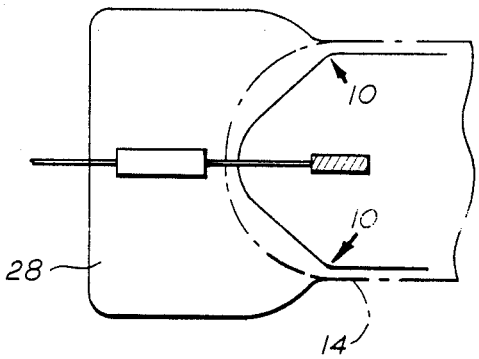
FIG. 10 illustrates a sectional view of a General Electric 400 watt arc tube with a blow molded end revealing the contours of the inner chamber, and showing the presence of end pockets.

Similarly, as illustrated in FIGS. 9 and 10, a General Electric 400 watt arc tube also made with blow molded ends 28 shows the presence of end pockets 10.

These illustrations represent typical blow molded lamps. Such end pockets can be eliminated by Method 1 described herein, and similarly, the blow molding process can be adapted as was the press sealing method (Method 2) to introduce a dimpling effect.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. An arc tube for an arc discharge lamp, said arc tube having a central axis, said arc tube comprising:

(a) a light-transmissive body hermetically enclosing an arc chamber and two opposed press seals abutting said body and running along said central axis, each of said press seals having opposed flat surfaces, there being a reference plane including said central axis and passing approximately mid-way between said opposed flat surfaces of both of said press seals and four reference points positioned in said reference plane at the junctures of the external surfaces of said press seals and said body;

(b) four dimples formed in said arc tube, each of said dimples being positioned at one of said reference points such that there are no end pockets in the interior surface of said arc chamber;

(c) two electrodes protruding into said arc chamber, each of said electrodes being imbedded in one of said press seals; and (d) a fill within said arc chamber, said fill including a gas capable of sustaining an arc discharge therethrough during operation of said arc tube.

2. An arc tube as described in claim 1 wherein each of said press seals has a width measured in said reference plane perpendicular to said central axis, said body has a maximum outer diameter measured in said reference plane perpendicular to said central axis, and each of said press seal widths is approximately equal to or greater than said maximum outer diameter of said body.

3. An arc tube as described in claim 1 wherein said arc tube is formed from quartz glass.

4. An arc tube as described in claim 1 wherein said fill includes a metal halide additive.

5. An arc tube as described in claim 1 wherein said arc tube is blow molded.

6. An arc discharge lamp comprising:

(a) a light-transmissive outer envelope enclosing an interior;

(b) an arc tube mounted within said interior, said arc tube having a central axis including:

(i) a light-transmissive body hermetically enclosing an arc chamber and two opposed press seals abutting said body and running along said central axis, each of said press seals having opposed flat surfaces, there being a reference plane including said central axis and passing approximately mid-way between said opposed flat surfaces of both of said press seals and four reference points positioned in said reference plane at the junctures of the external surfaces of said press seals and said body;

(ii) four dimples formed in said arc tube, each of said dimples being positioned at one of said reference points such that there are no end pockets in the interior surface of said arc chamber;

(iii) two electrodes protruding into said arc chamber, each of said electrodes being imbedded in one of said press seals; and (iv) a fill within said arc chamber, said fill including a gas capable of sustaining an arc discharge therethrough during operation of said lamp; and (c) means for structurally and electrically completing said lamp.

7. A lamp as described in claim 6 wherein each of said press seals of said arc tube has a width measured in said reference plane perpendicular to said central axis, said body has a maximum outer diameter measured in said reference plane perpendicular to said central axis, and each of said press seal widths is approximately equal to or greater than said maximum outer diameter of said body.

8. A lamp as described in claim 6 wherein said arc tube is formed from quartz glass.

9. A lamp as described in claim 6 wherein said fill of said arc tube includes a metal halide additive.

10. A lamp as described in claim 6 wherein said arc tube is blow molded.

* * * * *